US007363708B2

(12) United States Patent
Tessien et al.

(10) Patent No.: US 7,363,708 B2
(45) Date of Patent: Apr. 29, 2008

(54) METHOD OF ASSEMBLING MULTIPLE PORT ASSEMBLIES IN A CAVITATION CHAMBER

(75) Inventors: Ross Alan Tessien, Nevada City, CA (US); David G. Beck, Tiburon, CA (US)

(73) Assignee: Impulse Devices, Inc., Grass Valley, CA (US)

( * ) Notice: Subject to any disclaimer, the term of this patent is extended or adjusted under 35 U.S.C. 154(b) by 480 days.

(21) Appl. No.: 10/942,656

(22) Filed: Sep. 16, 2004

(65) Prior Publication Data

US 2006/0042089 A1 Mar. 2, 2006

Related U.S. Application Data

(63) Continuation-in-part of application No. 10/926,602, filed on Aug. 25, 2004, now abandoned.

(51) Int. Cl.
*B21D 51/16* (2006.01)
*B06B 1/00* (2006.01)
*B23P 11/02* (2006.01)

(52) U.S. Cl. ..... 29/890.09; 29/451; 422/128

(58) Field of Classification Search ..... 29/890.09, 29/451, 453, 464, 469, 525.01, 428, 592, 29/594; 422/128, 127; 137/803
See application file for complete search history.

(56) References Cited

U.S. PATENT DOCUMENTS 4,333,796 A 6/1982 Flynn
4,448,743 A 5/1984 Bass
4,563,341 A 1/1986 Flynn (Continued)

FOREIGN PATENT DOCUMENTS

WO PCT/US00/31341 5/2001

OTHER PUBLICATIONS

Blake et al, Acoustic Cavitation: The Fluid Dynamics of Non-Spherical Bubbles, Phil. Trans. R. Soc. Lond. A, 1999, pp. 251-267, vol. 357, Publisher: The Royal Society, Published in: Great Britain.

(Continued)

*Primary Examiner*—John C Hong
(74) *Attorney, Agent, or Firm*—C. Brandon Browning; Maynard, Cooper & Gale, P.C.

(57) ABSTRACT

A method of assembling multiple port assemblies in a cavitation chamber is provided. The method is comprised of boring at least two ports of different sizes in a cavitation chamber wall of the cavitation chamber. The external port diameter of the smaller port is smaller than that port's internal port diameter. A member selected from the group consisting of windows, plugs, feed-throughs, sensors, transducers and couplers is inserted into the chamber through the larger port and positioned within the smaller port. The member can be secured within the smaller port with an adhesive. A mounting ring/retaining ring, retaining coupler or port cover seals the second, larger port. A second member selected from the group consisting of windows, plugs, feed-throughs, sensors, transducers and couplers can be positioned within a cone-shaped port within the mounting ring or retaining coupler. A feed-thru, sensor, transducer or coupler can be integrated into the port cover. To aid the assembly process, specialized tools can be used to position the member within the smaller port.

46 Claims, 9 Drawing Sheets

U.S. PATENT DOCUMENTS

| | | | | |
|---|---|---|---|---|
| 5,659,173 | A | 8/1997 | Putterman et al. | |
| 5,665,917 | A * | 9/1997 | Berman | 73/662 |
| 5,858,104 | A | 1/1999 | Clark | |
| 6,361,747 | B1 | 3/2002 | Dion et al. | |

OTHER PUBLICATIONS

Dan et al, Ambient Pressure Effect on Single-Bubble Sonoluminescence, Physical Review Letters, Aug. 30, 1999, pp. 1870-1873, vol. 83, No. 9, Published in: US.

Moss et al., Computed Optical Emissions from a Sonoluminescing Bubble, Physical Review E, Mar. 1999, pp. 2986-2992, vol. 59, No. 3, Published in: US.

Gaitan et al, Experimental Observations of Bubble Response and Light Intensity Near the Threshold for Single Bubble Sonoluminescence, Physical Review E, May 1999, pp. 5495-5502, vol. 59, No. 5, Published in: US.

Barber et al, Sensitivity of Sonoluminescence to Experimental Parameters, Physical Review Letters, Feb. 28, 1994, pp. 1380-1382, vol. 72, No. 9.

Putterman, Sonoluminescence:Sound Into Light, Scientific American, Feb. 1995, pp. 46-51.

Gaitan et al, Sonoluminescence and Bubble Dynamics for a Single, Stable, Cavitation Bubble, J. Acoust. Soc. Am., Jun. 1992, pp. 3166-3183, vol. 91, No. 6.

Crum, Sonoluminescence, Physics Today, Sep. 1994, pp. 22-29.

Bollinger, Ultra Cavitation, http://wiretap.area.com/Gopher/Library/Article/Sci/cavitate.ult, Sep. 17, 2001, pp. 1-26.

* cited by examiner

METHOD OF ASSEMBLING MULTIPLE PORT ASSEMBLIES IN A CAVITATION CHAMBER

REFERENCE TO RELATED APPLICATIONS

This application is a continuation-in-part of U.S. patent application Ser. No. 10/926,602, filed Aug. 25, 2004 now abandoned.

FIELD OF THE INVENTION

The present invention relates generally to sonoluminescence and, more particularly, to a port assembly for use with a sonoluminescence cavitation chamber.

BACKGROUND OF THE INVENTION

Sonoluminescence is a well-known phenomena discovered in the 1930's in which light is generated when a liquid is cavitated. Although a variety of techniques for cavitating the liquid are known (e.g., spark discharge, laser pulse, flowing the liquid through a Venturi tube), one of the most common techniques is through the application of high intensity sound waves.

In essence, the cavitation process consists of three stages; bubble formation, growth and subsequent collapse. The bubble or bubbles cavitated during this process absorb the applied energy, for example sound energy, and then release the energy in the form of light emission during an extremely brief period of time. The intensity of the generated light depends on a variety of factors including the physical properties of the liquid (e.g., density, surface tension, vapor pressure, chemical structure, temperature, hydrostatic pressure, etc.) and the applied energy (e.g., sound wave amplitude, sound wave frequency, etc.).

Although it is generally recognized that during the collapse of a cavitating bubble extremely high temperature plasmas are developed, leading to the observed sonoluminescence effect, many aspects of the phenomena have not yet been characterized. As such, the phenomena is at the heart of a considerable amount of research as scientists attempt to not only completely characterize the phenomena (e.g., effects of pressure on the cavitating medium), but also its many applications (e.g., sonochemistry, chemical detoxification, ultrasonic cleaning, etc.).

In order to study the sonoluminescence phenomena, it is clearly important to be able to closely monitor the cavitating bubbles as well as the intensity, frequency and timing of the resultant sonoluminescence. Additionally, some research may require probing the cavitating liquid. Lastly, many cavitation experiments utilize external means of introducing the bubbles into the liquid, for example bubble tubes or hot wires, thus requiring further means of entering the cavitating medium.

Although access to the liquid within a cavitation chamber is typically required before, during and after a cavitation experiment, typically this does not present a problem as most cavitation research is performed at relatively low pressure. As such, glass or other transparent material is generally used for the chamber, thus providing an easy means of monitoring on-going experiments. Additionally, such experiments often use standard beakers or flasks as the cavitation chamber, allowing convenient access to the cavitation medium.

U.S. Pat. No. 4,333,796 discloses a cavitation chamber that is generally cylindrical although the inventors note that other shapes, such as spherical, can also be used. As disclosed, the chamber is comprised of a refractory metal such as tungsten, titanium, molybdenum, rhenium or some alloy thereof and the cavitation medium is a liquid metal such as lithium or an alloy thereof. Surrounding the cavitation chamber is a housing which is purportedly used as a neutron and tritium shield. Projecting through both the outer housing and the cavitation chamber walls are a number of acoustic horns. The specification only discloses that the horns, through the use of flanges, are secured to the chamber/housing walls in such a way as to provide a seal. Similarly, although the specification discloses the use of a tube to distribute H-isotopes into the host material during cavitation, the specification does not disclose how the tube is to be sealed as it passes through the chamber/housing walls. Similarly U.S. Pat. No. 4,563,341, a continuation-in-part of U.S. Pat. No. 4,333,796, does not disclose means for the inclusion of a port with the disclosed cylindrical chamber.

U.S. Pat. No. 5,659,173 discloses a sonoluminescence system that uses a transparent spherical flask. The spherical flask is not described in detail, although the specification discloses that flasks of Pyrex®, Kontes®, and glass were used with sizes ranging from 10 milliliters to 5 liters. As the disclosed flask is transparent, the PMT used to monitor the sonoluminescence was external to the chamber. The drivers as well as a microphone piezoelectric were epoxied to the exterior surface of the chamber. The use of a transparent chamber also allowed the use of an external light source, e.g., a laser, to determine bubble radius without requiring the inclusion of a window in the chamber walls.

U.S. Pat. No. 5,858,104 discloses a shock wave chamber partially filled with a liquid. The remaining portion of the chamber is filled with gas which can be pressurized by a connected pressure source. Acoustic transducers are used to position an object within the chamber. Another transducer delivers a compressional acoustic shock wave into the liquid. A flexible membrane separating the liquid from the gas reflects the compressional shock wave as a dilation wave focused on the location of the object about which a bubble is formed. The patent simply discloses that the transducers are mounted in the chamber walls without stating how the transducers are to be mounted. Similarly, there is no discussion of mounting ports (e.g., view ports) within the chamber walls.

U.S. Pat. No. 6,361,747 discloses an acoustic cavitation reactor in which the reactor chamber is comprised of a flexible tube. The liquid to be treated circulates through the tube. Electroacoustic transducers are radially distributed around the tube, apparently coupled to the flexible tube by being pressed against the exterior surface of the tube. The heads of the transducers have the same curvature as the tube, thus helping to couple the acoustic energy. A film of lubricant interposed between the transducer heads and the wall of the tube further aid the coupling of the acoustic energy to the tube.

Although not in the field of sonoluminescence, U.S. Pat. No. 4,448,743 discloses a confinement chamber for use with an ultra-high temperature steady-state plasma. The specification refers to the plasma as a plasmasphere but is unclear as to whether the confinement chamber is spherical or cylindrical in nature. The disclosed chamber includes multiple transparent ports, for example made of germanium or sodium chloride, but does not disclose how the ports are fabricated or installed within the chamber.

One approach to fabricating a high pressure spherical cavitation chamber is disclosed in co-pending patent application Ser. No. 10/925,070, filed Aug. 23, 2004, entitled Method of Fabricating a Spherical Cavitation Chamber. In order to provide optimum high pressure performance, in addition to being spherically shaped, the inside spherical surface has only a very minor fabrication seam. Such a chamber, however, provides a challenge as to port mounting, especially if the smooth inside surface and the high pressure aspects of the chamber are to be maintained.

Accordingly, what is needed is a means of including one or more ports in a high pressure cavitation chamber. The present invention provides such a port assembly.

SUMMARY OF THE INVENTION

The present invention provides a method of assembling multiple port assemblies in a cavitation chamber, typically a spherical chamber. The method is comprised of the steps of boring a first cone-shaped port in a cavitation chamber wall of the cavitation chamber; boring a second, larger cone-shaped port in the cavitation chamber wall; inserting a first cone-shaped member corresponding to the first, smaller cone-shaped port into the cavitation chamber through the second, larger cone-shaped port; positioning the first cone-shaped member in the first, smaller cone-shaped port; positioning a second cone-shaped member within a corresponding internal cone-shaped surface of a mounting ring; positioning the mounting ring within the second, larger cone-shaped port; and locking the mounting ring in place with a retaining ring. The smallest diameter of the second, larger port is larger than the largest diameter of the first member, thus insuring that the member can be inserted into the cavitation chamber through the port. The first and/or second members can be secured in place with an adhesive. The first and second members can be windows, plugs, gas feed-throughs, liquid feed-throughs, mechanical feed-throughs, sensors, sensor couplers, or transducer couplers. To aid the assembly process, specialized tools can be used to position the first member.

In at least one embodiment, the method is comprised of the steps of boring a first cone-shaped port in a cavitation chamber wall of the cavitation chamber; boring a second, larger port in the cavitation chamber wall; inserting a first cone-shaped member corresponding to the first, smaller cone-shaped port into the cavitation chamber through the second, larger port; positioning the first cone-shaped member in the first, smaller cone-shaped port; positioning a second cone-shaped member within a corresponding internal cone-shaped surface of a retaining coupler; positioning the retaining coupler within the second, larger port; and locking the retaining coupler in place. The second port can be cone-shaped with the external port diameter being larger than the internal port diameter. Alternately the second port can be cylindrically-shaped. The smallest diameter of the second, larger port is larger than the largest diameter of the first member, thus insuring that the first member can be inserted into the cavitation chamber through the port. The first and/or second members can be secured in place with an adhesive. The first and second members can be windows, plugs, gas feed-throughs, liquid feed-throughs, mechanical feed-throughs, sensors, sensor couplers, or transducer couplers. To aid the assembly process, specialized tools can be used to position the first member.

In at least one embodiment, the method is comprised of the steps of boring a first cone-shaped port in a cavitation chamber wall of the cavitation chamber; boring a second, larger port in the cavitation chamber wall; inserting a cone-shaped member corresponding to the first, smaller cone-shaped port into the cavitation chamber through the second, larger port; positioning the cone-shaped member in the first, smaller cone-shaped port; positioning a port cover within the second, larger port; and locking the port cover in place. The second port can be cone-shaped with the external port diameter being larger than the internal port diameter. Alternately the second port can be cylindrically-shaped. The smallest diameter of the second, larger port is larger than the largest diameter of the member, thus insuring that the member can be inserted into the cavitation chamber through the port. The member and/or port cover can be secured in place with an adhesive. The member can be a window, plug, gas feed-thru, liquid feed-thru, mechanical feed-thru, sensor, sensor coupler, or transducer coupler. A feed-thru (e.g., a gas feed-thru, liquid feed-thru, mechanical feed-thru, etc.), sensor or transducer can be integrated into the port cover. To aid the assembly process, specialized tools can be used to position the member.

A further understanding of the nature and advantages of the present invention may be realized by reference to the remaining portions of the specification and the drawings.

DESCRIPTION OF THE SPECIFIC EMBODIMENTS

Figure 1:
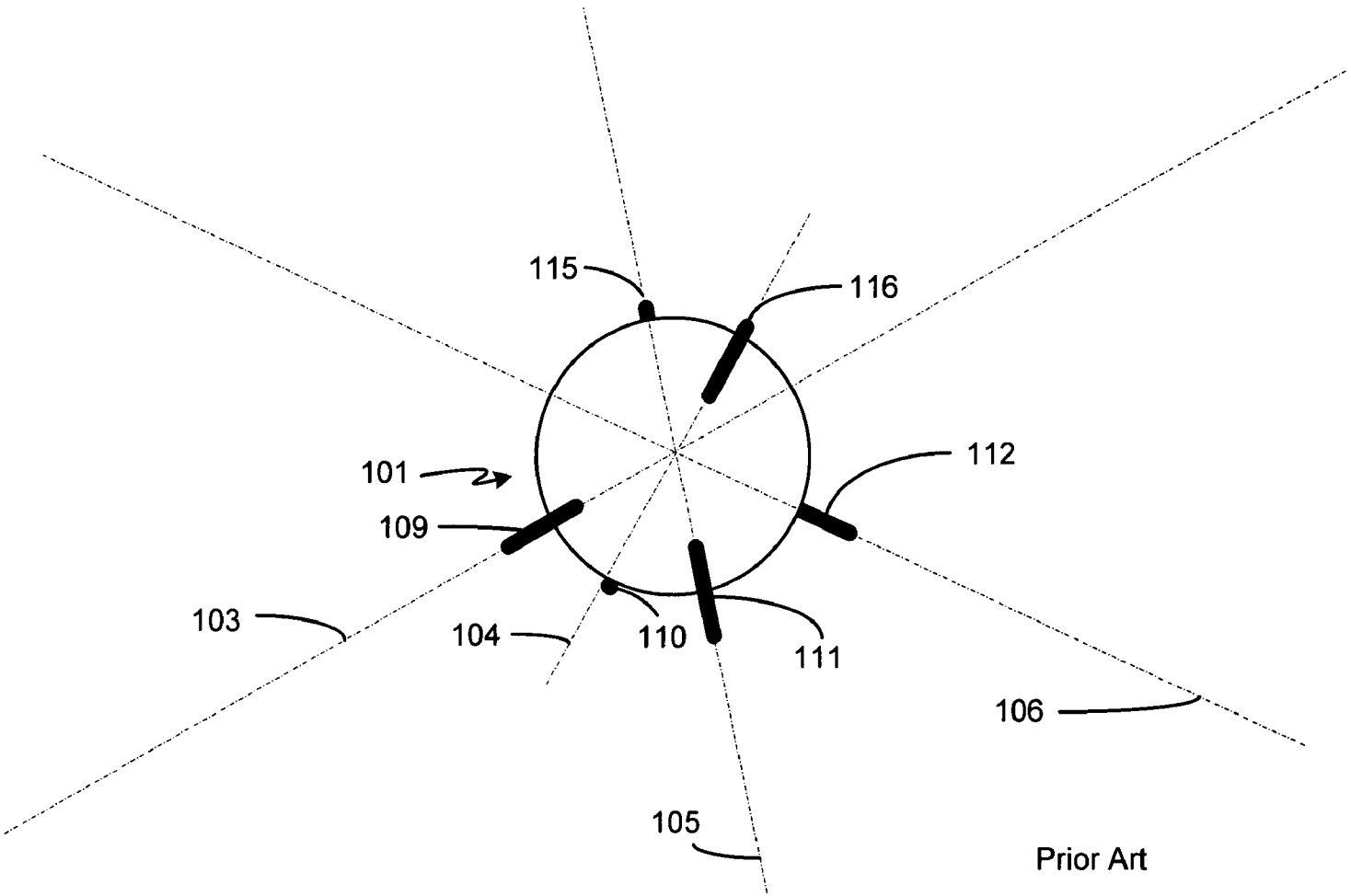
FIG. 1 is an illustration of a spherical sonoluminescence cavitation chamber without ports in accordance with the prior art.

FIG. 1 is an illustration of a spherical sonoluminescence cavitation chamber 101, hereafter referred to as simply a cavitation chamber, according to the prior art. Transducers 109-112 are mounted to the lower hemisphere of chamber 101 and transducers 115-116 are mounted to the upper hemisphere of chamber 101.

Figure 2:
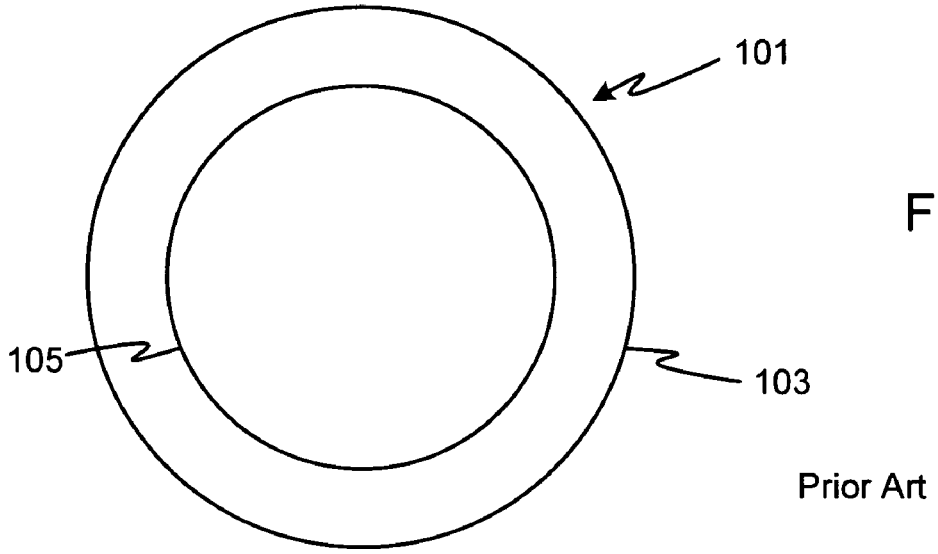
FIG. 2 is a cross-sectional view of the spherical cavitation chamber shown in FIG. 1.

FIG. 2 is a cross-sectional view of spherical cavitation chamber 101. Chamber 101 has an outer spherical surface 103 defining the outer diameter of the chamber, and an inner spherical surface 105 defining the inner diameter of the chamber.

Chamber 101 can be fabricated from any of a variety of materials, depending primarily on the desired operating temperature and pressure, as well as the fabrication techniques used to make the chamber. Typically the chamber is fabricated from a metal; either a pure metal or an alloy such as stainless steel.

With respect to the dimensions of the chamber, both inner and outer diameters, the selected sizes depend upon the intended use of the chamber. For example, smaller chambers are typically preferable for situations in which the applied energy (e.g., acoustic energy) is somewhat limited. Similarly, thick chamber walls are preferable if the chamber is to be operated at high static pressures. For example, the prior art discloses wall thicknesses of 0.25 inches, 0.5 inches, 0.75 inches, 1.5 inches, 2.375 inches, 3.5 inches and 4 inches, and outside diameters in the range of 2-10 inches.

Although the present invention is not limited to a particular chamber configuration, for illustration purposes only spherical chambers are described in detail. It will further be appreciated that with respect to spherical chambers, the present invention is not limited to a particular outside chamber diameter, inside chamber diameter, chamber material, chamber shape, transducer type, transducer number, or transducer mounting location. Such information, as provided herein, is only meant to provide exemplary chamber configurations for which the present invention is applicable.

Figure 3:
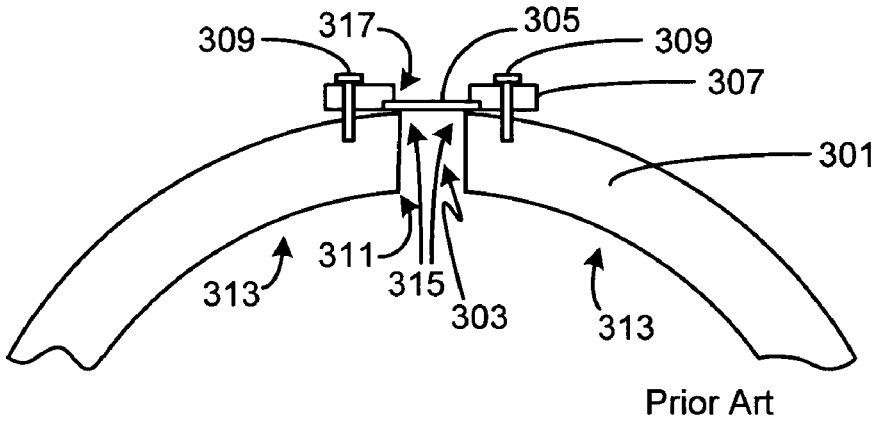
FIG. 3 is a cross-sectional view of a port assembly, including a window, in accordance with the prior art.

FIG. 3 is a cross-sectional view of a window and port assembly in accordance with the prior art. For ease of illustration, only a portion of wall 301 of a spherical chamber such as the one provided in FIG. 2 is shown in the following figures. A port 303 has been bored through wall 301. In the illustrated embodiment, port 303 is used as an observation port, thus requiring a window 305 to be placed over the port. Window 305 is attached using a standard window mounting flange 307, the flange being held to wall 301 with multiple bolts 309. Typically a window sealing member, not shown, is included in this configuration to insure a gas tight assembly.

The prior art means of providing a port, as well as the prior art means of attaching a window or other member to the port, suffers from several problems. First, the edge 311 of the port presents a significant discontinuity along surface 313 of wall 301, the discontinuity affecting the cavitation process. Second, for high pressure systems the window of this port assembly is prone to failure as there is minimal contact area between window 305 and wall 301 (i.e., area 315) and minimal contact area between window 305 and flange 307 (i.e., area 317). Third, it is difficult to achieve an adequate seal between the window (or similar port member) and wall 301.

Figure 4:
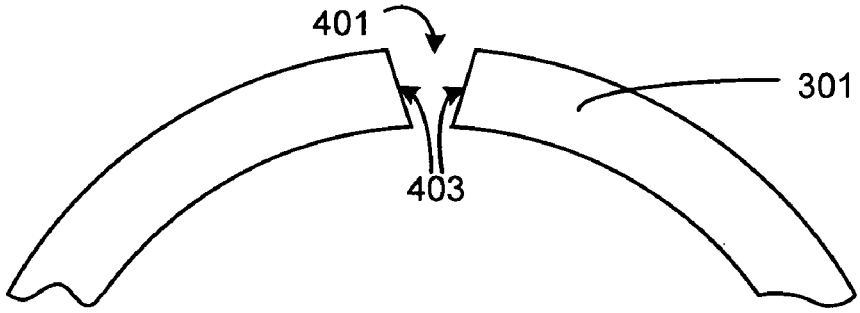
FIG. 4 is a cross-sectional view of a cone-shaped port.
Figure 5:
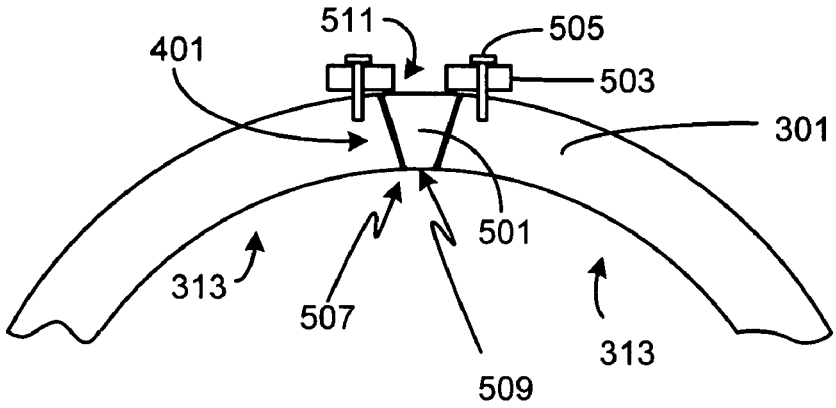
FIG. 5 is a cross-sectional view of a cone-shaped window or plug within the port of FIG. 4.

One approach to alleviating at least some of the issues of the prior art port assembly is illustrated in FIGS. 4 and 5. As shown, the port 401 bored into chamber wall 301 includes slanted surfaces 403, thus providing a cone-shaped port. A similarly shaped window (or plug) 501 fits within port 401, held in place with retaining ring 503. Retaining ring 503 is mounted to chamber wall 301 with a plurality of bolts 505.

One benefit of the assembly shown in FIG. 5 is that the window is much thicker, thus making it less prone to breakage or gas leaks. Additionally the discontinuity at region 507 is greatly reduced as the window can be made thick enough so that the interior surface 509 of window 501 is in line with interior chamber surface 313. If desired, window surface 509 can even be fabricated with the same curvature as the interior chamber surface, thus minimizing internal chamber variations.

Although the assembly shown in FIGS. 4 and 5 is an improvement over the prior art port assembly, especially when used with an evacuated chamber, when used with a high pressure system it still applies stress to the window (or port plug) in a relatively small region 511. This is because the shape of member 501 does not provide any sealing or holding mechanism. Unless a strong bonding material is provided at the interface between member 501 and port 401, only retaining ring 503 holds member 501 in place. Accordingly this places a great amount of stress in a very small area, thus leading to frequent window breakage when used at high pressure.

Figure 6:
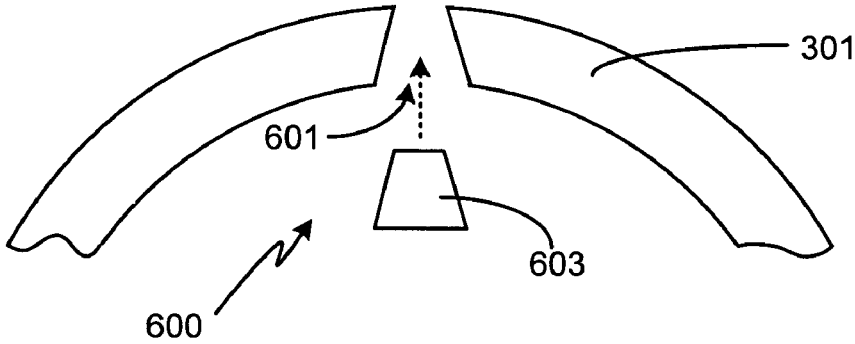
FIG. 6 is a cross-sectional view of a cone-shaped port in which the configuration of the port is reversed from the port shown in FIG. 4.

FIG. 6 illustrates an embodiment of the invention useful with high internal pressure chambers. In this embodiment port 601 is again cone-shaped. Unlike the previous embodiment, however, the direction of port 601 is reversed so that the small diameter of the port is located on the outer surface of chamber wall 301. Assuming a window (or plug) 603, it will be appreciated that the pressure within the chamber would push member 603 outward, thus providing not only an improved seal, but more importantly a means of distributing the force over a much larger region than in the port assemblies shown in FIGS. 3 and 5. As a result, member 603 is less likely to crack or break during use.

Although the embodiment shown in FIG. 6 has an improved resistance to stress-induced breakage, the inventors have found this embodiment to be problematic as member 603 cannot be easily replaced once the cavitation chamber is fabricated. Thus either the chamber must be capable of being disassembled/reassembled or a chamber access port that allows suitable access to member 603 must be provided.

Figure 7:
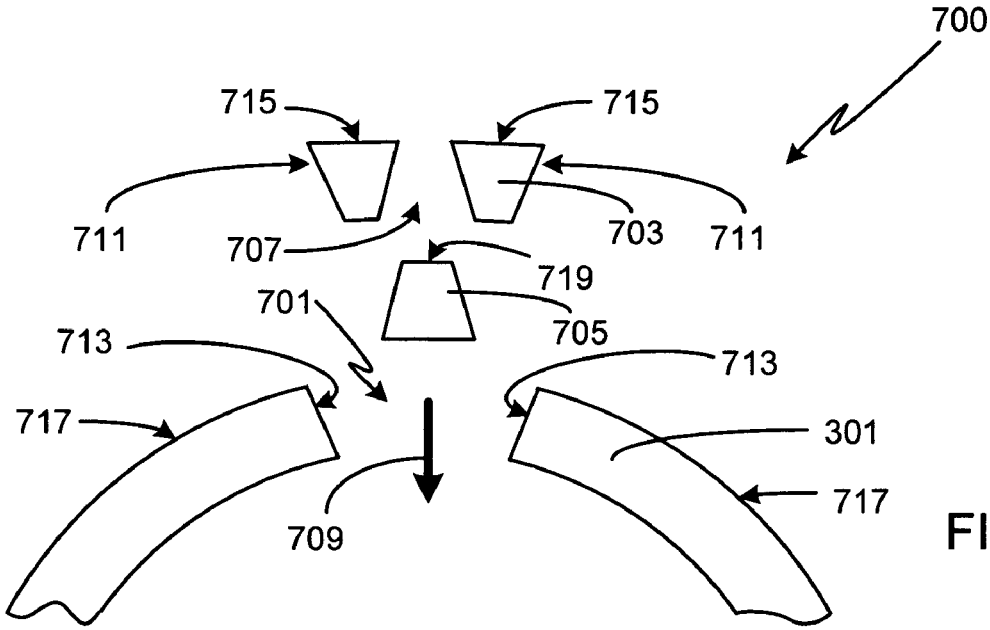
FIG. 7 is a cross-sectional view of a port assembly that includes a cone-shaped port, a cone-shaped mounting ring and a cone-shaped member.

FIG. 7 illustrates a portion of a preferred embodiment of the invention. As shown in the exploded view of FIG. 7, this embodiment include a cone-shaped port 701, a cone-shaped mounting ring 703 and a central member 705. Member 705 can be a window, gas feed-thru, liquid feed-thru, sensor (e.g., thermocouple), sensor coupler, mechanical feed-thru (e.g., manipulating arm), transducer coupler, plug, or any other suitably shaped member.

Port 701 can either be bored into chamber wall 301 before assembly of the cavitation chamber is complete, or after. The benefit of boring the port prior to chamber completion is that it is easier to clean the inside chamber surfaces before the final chamber assembly. Depending upon the method used to bore port 701, it may also be easier to bore the hole prior to chamber assembly.

After chamber completion, for example as described in co-pending application Ser. No. 10/925,070, filed Aug. 23, 2004, entitled Method of Fabricating a Spherical Cavitation Chamber, the disclosure of which is incorporated herein for any and all purposes, member 705 is placed within the cone-shaped port 707 of mounting ring 703. Preferably member 705 is locked into place, for example using one of the means described below (e.g., an adhesive). The combination of mounting ring 703 and member 705 is then placed within port 701 after which a retaining ring 801 (shown in FIG. 8) is used to lock the assembly into place.

The primary benefit of the port assembly of the present invention over an assembly such as those illustrated in FIGS. 3 and 5 is apparent at high pressures. As previously noted, at high pressures many fragile materials, such as those employed in windows, are prone to cracking when a large force is focused on a small region (e.g., regions 315 and 317 in FIG. 3 and region 511 in FIG. 5). The present invention overcomes this problem by distributing the force over a larger area. Therefore as noted with respect to FIG. 6, the force applied by the pressure within the cavitation chamber is applied over a large area of member 705. It is assumed that mounting ring 703 is fabricated from a material that is less susceptible to fracture/damage. For example in the preferred embodiment, mounting ring 703 is fabricated from the same material as the chamber. Furthermore, due to the use of more robust materials for mounting ring 703, generally it is not difficult to achieve a seal between chamber walls 301 and mounting ring 703. An additional benefit of the invention is the ease by which member 705 can be replaced; simply by removing mounting ring 703.

Figure 8:
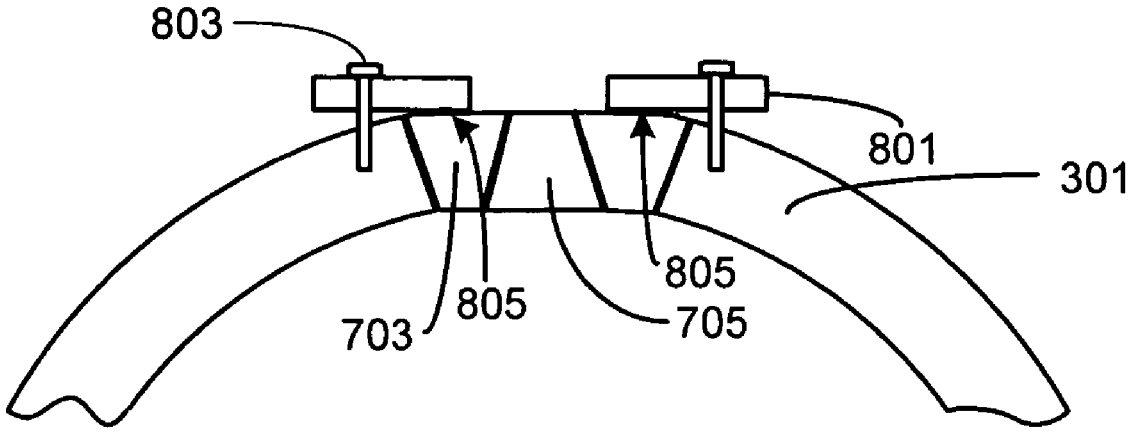
FIG. 8 is a cross-sectional view of the port assembly of FIG. 7 assembled, the assembly including a retaining ring.

It should be appreciated that there are countless minor variations to the embodiment illustrated in FIGS. 7 and 8 which enjoy the benefits of the present invention and which are clearly envisioned by the inventors. A few of the basic variations are shown below.

Figure 9:
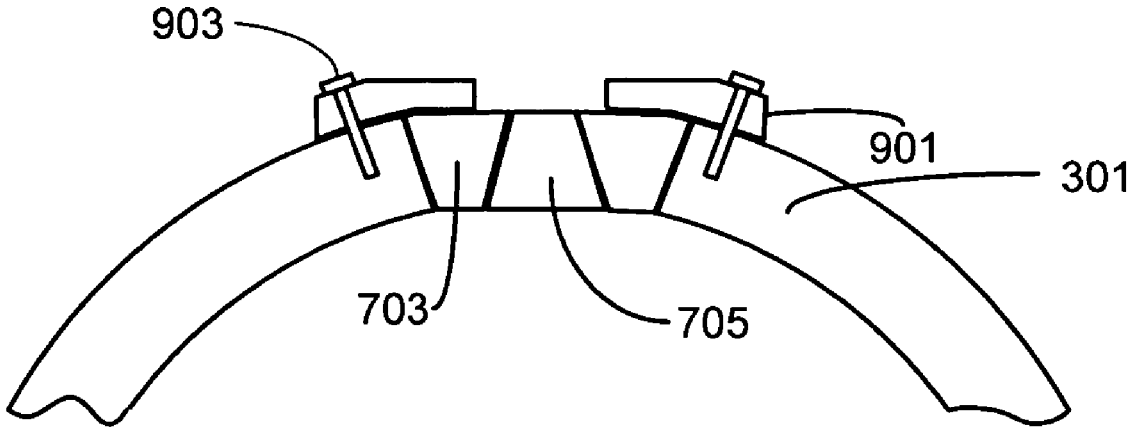
FIG. 9 is an illustration of a port assembly similar to that shown in FIG. 7 except that the surface of the retaining ring adjacent to the external chamber surface is shaped.

FIG. 9 is an illustration of an embodiment in which the surface of the retaining ring 901 adjacent to the external surface of chamber wall 301 is shaped, preferably such that it has the same, or approximately the same, curvature as the chamber wall. It will be appreciated that retaining bolts 901 can be perpendicular to chamber wall 301 as shown in FIG. 9, perpendicular to a retaining ring surface as shown in FIG. 8, or at some other convenient angle.

Regardless of the exact shape of the retaining ring, it will be appreciated that the retaining ring can be used to push the external cone-shaped surface of the mounting ring against the adjacent cone-shaped port surfaces, thus improving the seal between the two pieces. In the embodiment shown in FIGS. 7 and 8, the surfaces in question are mounting ring surface 711 and port surface 713. In order to apply the desired force on the mounting ring, preferably either the external mounting ring chamber surface (e.g., surface 715 in FIG. 7) extends slightly past the external chamber surface (e.g., surface 717 in FIG. 7) or the retaining ring surface (e.g., surface 805 in FIG. 8) adjacent to the external mounting ring chamber surface contacts the mounting ring surface prior to the retaining ring contacting the chamber external surface.

Figure 10:
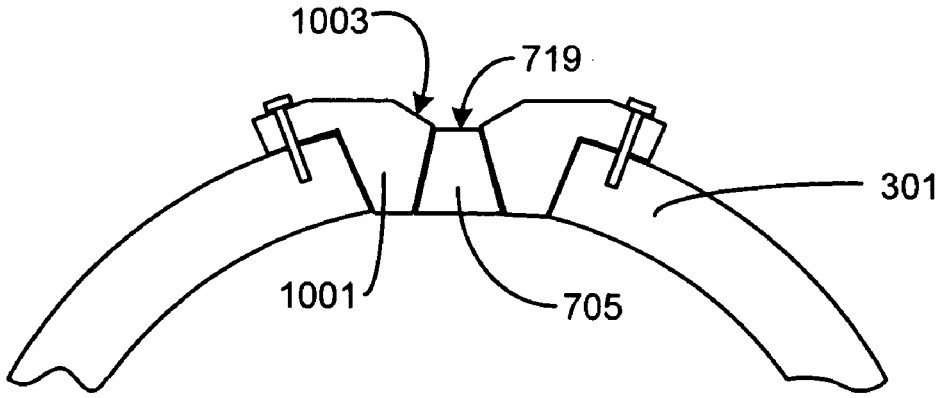
FIG. 10 is an illustration of an embodiment of the invention with a cone-shaped retaining coupler.
Figure 11:
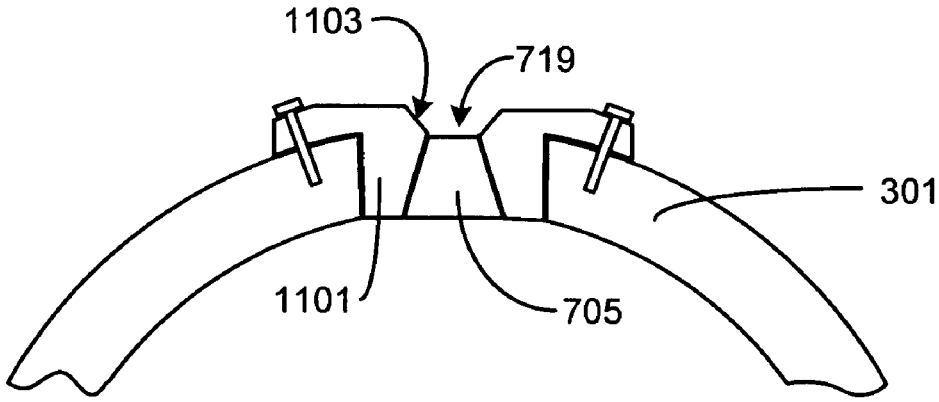
FIG. 11 is an illustration of an embodiment of the invention with a cylindrically-shaped retaining coupler.

FIGS. 10 and 11 illustrate preferred embodiments of the invention in which the mounting ring and the retaining ring are combined into a single piece hereafter referred to as a retaining coupler. The use of a single piece retaining coupler improves the ease by which a high pressure seal can be achieved between the port assembly and the cavitation chamber. Additionally the retaining coupler further simplifies assembly. FIG. 10 illustrates a retaining coupler 1001 designed to fit within a cone-shaped port while FIG. 11 illustrates a retaining coupler 1101 designed to fit within a cylindrically-shaped port. Although not required, the embodiments shown in FIGS. 10 and 11 also include chamfered surfaces 1003 and 1103, respectively, the chamfered surfaces providing enhanced visibility of external central member surface 719, primarily useful when the central member is a window.

Figure 12:
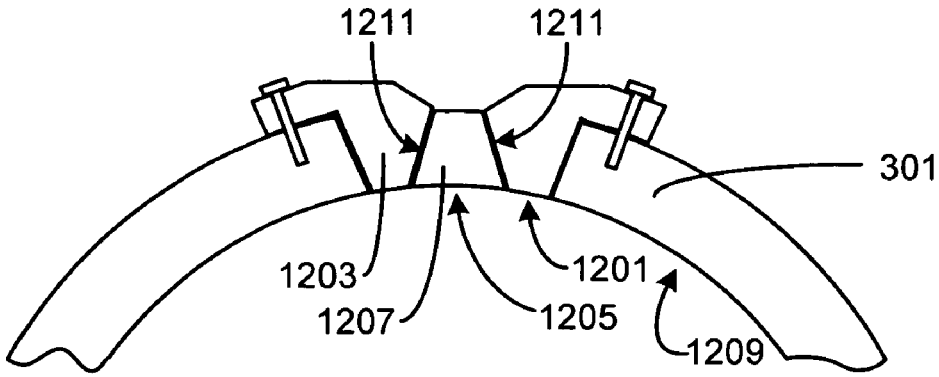
FIG. 12 is an illustration of an embodiment similar to that shown in FIG. 10 except that the inner chamber surfaces of the retaining coupler and the central member are shaped to match the spherical shape of the cavitation chamber inner surface.

In the embodiments shown in FIGS. 8-11, the surfaces of the central member (e.g., member 705) and the mounting ring or retaining coupler that, upon assembly, become part of the inner surface of the cavitation chamber are shown as flat. In a preferred embodiment, however, these surfaces are curved to match the spherical curvature of the internal surface of cavitation chamber 101 as illustrated in FIG. 12. As shown, both surface 1201 of retaining coupler 1203 and surface 1205 of member 1207 are shaped to match the spherical curvature of surface 1209 of chamber 101. It will be understood, however, that if desired only one of these surfaces may be curved while the other is flat (not shown). It will also be understood that shaping the internal chamber surfaces of the central member, mounting ring and/or retaining coupler is equally applicable to the other embodiments of the invention.

Although the embodiments shown above distribute the force on the central member (e.g., member 705 and member 1207), thus minimizing deformation and/or breakage of the central member, in a preferred embodiment of the invention a thin sheet or foil of malleable material 1211, for example brass or other malleable metal, is interposed between member 1207 and retaining coupler 1203. Although the inclusion of malleable material 1211 is only indicated in FIG. 12, it should be understood that it can be used with any of the embodiments of the invention, not just the embodiment shown in FIG. 12. Additionally it should be understood that malleable material 1211 is not required by the invention although it has been found to be particularly useful when the central member is fabricated from a relatively fragile material (e.g., glass or sapphire window). Although a similar malleable material can be interposed between the port and the mounting ring (or retaining coupler), it is typically not required given that the mounting ring (or retaining coupler) is preferably fabricated from a metal such as that used to fabricate the cavitation chamber.

In one preferred embodiment, a sealant and/or adhesive is interposed between one or more adjoining port assembly surfaces. For example, a sealant and/or adhesive can be interposed between adjoining surfaces of the central member and the mounting ring (or retaining coupler), thus holding the central member in place during port assembly and when the chamber is evacuated (e.g., during degassing or operation). Alternately, or in addition to, a sealant and/or adhesive can be interposed between the adjoining surfaces of the mounting ring (or retaining coupler) and the port. Alternately, or in addition to, a sealant and/or adhesive can be interposed between the adjoining surfaces of the retaining ring (or retaining coupler) and the external chamber surface.

Figure 13:
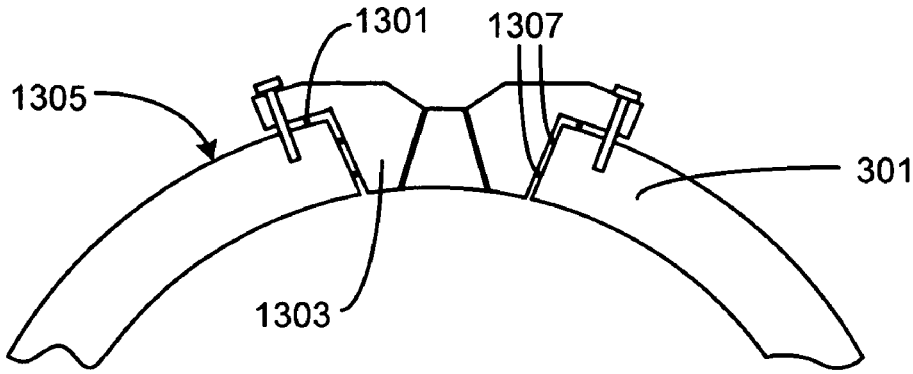
FIG. 13 is an illustration of an embodiment similar to that shown in FIG. 12 except for the inclusion of o-rings interposed between the adjoining surfaces of the retaining coupler and the cavitation chamber.

In one preferred embodiment, one or more o-rings are interposed between the adjoining surfaces of the mounting ring (or retaining coupler) and the port (and/or external chamber surface). FIG. 13 illustrates an exemplary embodiment in which an o-ring 1301 is interposed between retaining coupler 1303 and external chamber surface 1305. Additionally a pair of o-rings 1307 are interposed between the adjoining surfaces of retaining coupler 1303 and the port. It will be appreciated that both fewer and greater numbers of o-rings can be used, that o-rings need not be located both between the coupler and the port and the coupler and the external chamber surface, and that o-rings can be used with any of the embodiments of the invention.

Figure 14:
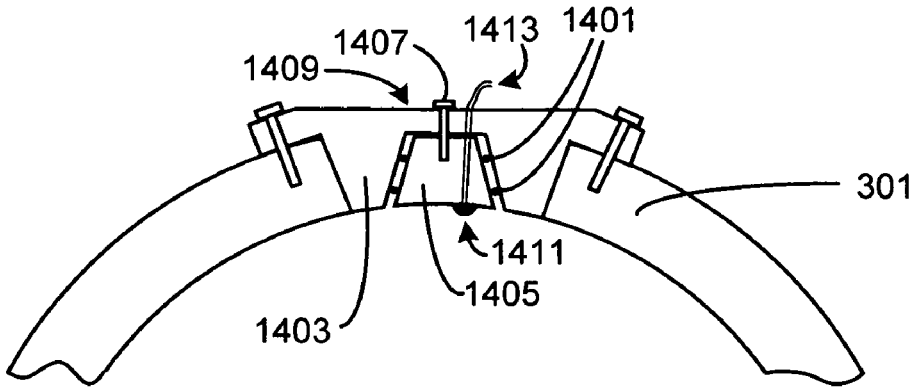
FIG. 14 is an illustration of an embodiment using a retaining coupler with a solid external surface and 0-rings interposed between the adjoining surfaces of the retaining coupler and the central member.
Figure 15:
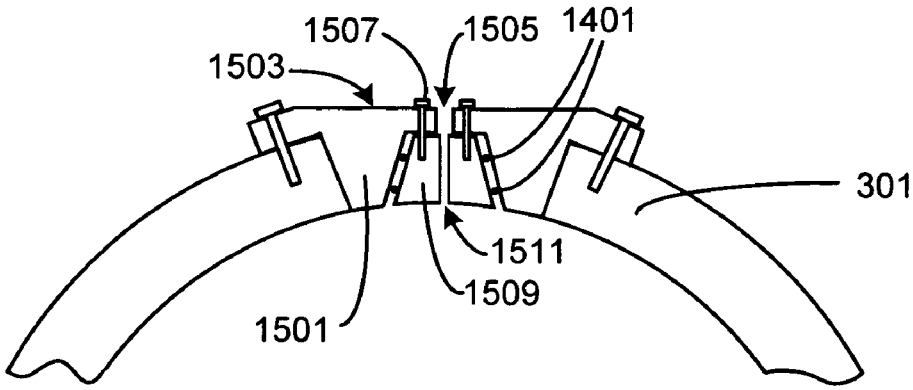
FIG. 15 is an illustration of an alternate configuration of that shown in FIG. 14 in which the retaining coupler includes a small port.

In one embodiment, one or more o-rings are interposed between the adjoining surfaces of the mounting ring (or retaining coupler) and the central member. As opposed to an adhesive (e.g., epoxy), o-rings will not hold the central member in place during chamber evacuation, accordingly o-rings are preferably used with the central member only when the central member can be secured using other means, for example one or more bolts. FIG. 14 illustrates an exemplary embodiment in which a pair of o-rings 1401 are interposed between retaining coupler 1403 and member 1405. In the illustrated embodiment the external surface of member 1405 is not accessible during chamber operation, i.e., member 1405 is not a window, thus allowing member 1405 to be secured, and o-rings 1401 to be compressed, with a bolt 1407. As shown, retaining coupler 1403 has a continuous, i.e., non-ported, external surface 1409 and member 1405 is outfitted with a sensor 1411 and coupled to the sensor electronics (not shown) via wires 1413. Preferably wires 1413 are bonded and sealed within member 1405 to insure that a gas-tight seal can be maintained. It will be appreciated that both fewer and greater numbers of o-rings can be used and that member 1405 can be used with feed-throughs, sensors, transducers, etc. FIG. 15 illustrates a minor variation of the embodiment shown in FIG. 14. As shown, retaining coupler 1501 does not have a continuous external surface 1503. Rather the external surface includes a small hole 1505 of sufficient size to accommodate wires, feed-throughs, etc. Although external surface 1503 includes hole 1505, it has sufficient surface area to allow one or more bolts 1507 to secure member 1509. Member 1509, as shown, includes a feed-thru 1511.

Figure 16:
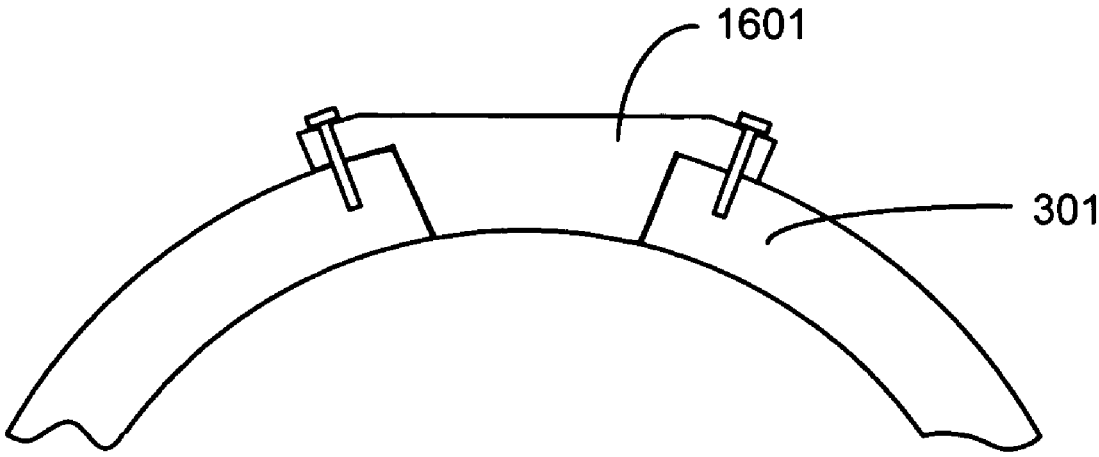
FIG. 16 is an illustration of a port cover for use as a port plug.
Figure 17:
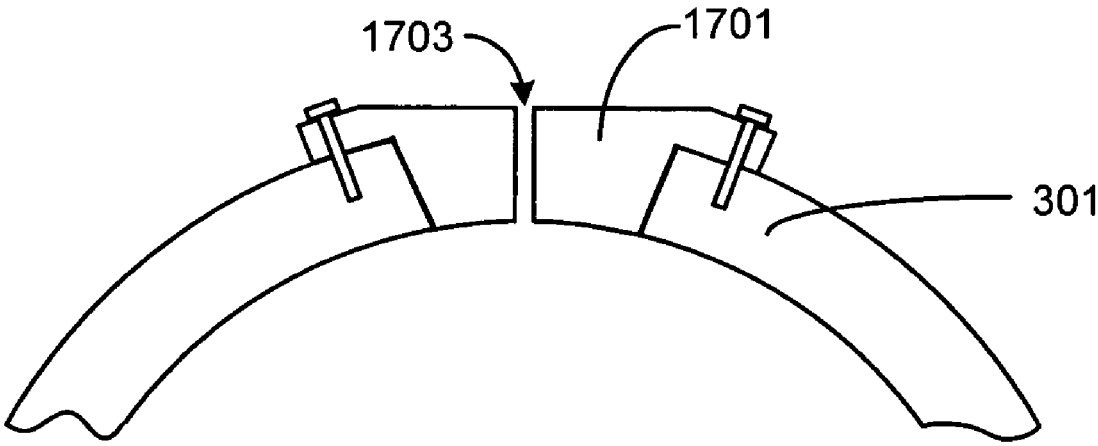
FIG. 17 is an illustration of a port cover configured with a feed-thru.

The inventors have also found that if the central member is not fragile (e.g., a quartz window), in many instances a simpler assembly can be obtained by using a single piece port cover as illustrated in FIGS. 16 and 17. Port cover 1601 (FIG. 16) is a solid cover (i.e., a plug) while port cover 1701 (FIG. 17) includes a feed-through 1703. It should be understood that a single piece port cover, such as the ones shown in FIGS. 16 and 17, can be used with either a cone-shaped port (e.g., port 701) or a cylindrical port (e.g., port shown in FIG. 11), and can be configured with a gas feed-thru, liquid feed-thru, sensor (e.g., thermocouple), sensor coupler, mechanical feed-thru (e.g., manipulating arm), transducer coupler, plug, etc.

Figure 18:
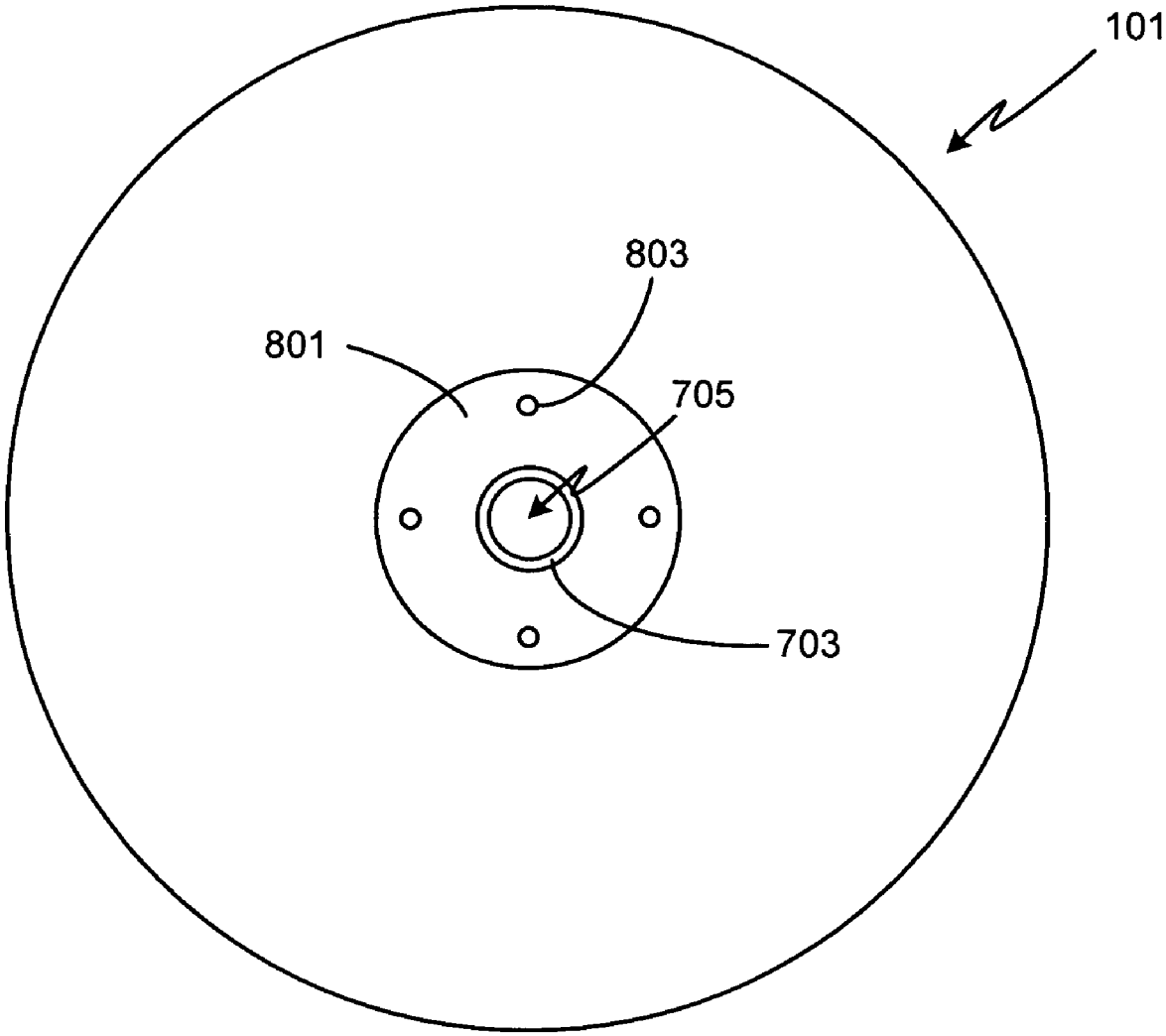
FIG. 18 is a frontal view of the port assembly shown in FIG. 8.

For clarity, FIG. 18 is a frontal view of one of the embodiments, specifically the assembly shown in FIG. 8. This view shows the external surface of cavitation chamber 101, member 705, the inside edge of mounting ring 703, retaining ring 801, and bolts 803. This figure, as with the other figures contained herein, is only meant to illustrate the invention and should not be considered to be a scale drawing.

The present invention, as described in detail above, not only provides a strong, load distributing port assembly which can be easily assembled/disassembled, it also provides a means of assembling/disassembling a port assembly such as that shown in FIG. 6. Accordingly a cavitation chamber can include one or more port assemblies 600 and a single port assembly such as those illustrated in FIGS. 7-18. In this embodiment prior to assembling a multi-piece port assembly (e.g., as shown in FIGS. 7-15), or a single piece port cover (e.g., FIGS. 16-17), port assembly (or assemblies) 600 is assembled. To assemble each port assembly 600, the corresponding member 603 is inserted through port 701 and positioned within the desired port 601, for example using the tools and methodology disclosed in co-pending application Ser. No. 10/926,602, filed Aug. 25, 2004, entitled Port Assembly for a Cavitation Chamber, the disclosure of which is incorporated herein for any and all purposes. After port assembly (or assemblies) 600 has been completed, port assembly 700 (or other assemblies/covers as shown in FIGS. 8-17) are assembled as described herein. If it becomes necessary to replace a member 603, it can be replaced through port 701 after a standard port disassembly procedure.

Figure 19:
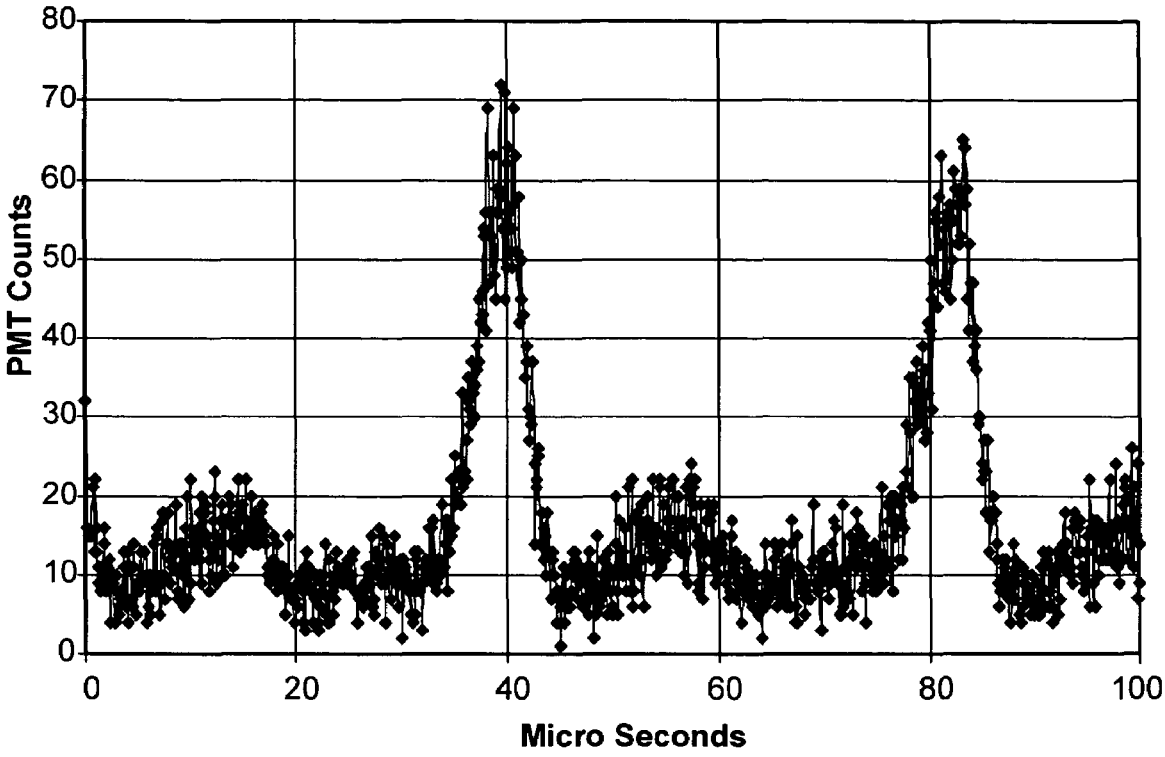
FIG. 19 is a graph of measured sonoluminescence data taken with a spherical cavitation chamber.

FIG. 19 is a graph that illustrates the sonoluminescence effect with a spherical cavitation sphere suitable for use with a port assembly fabricated in accordance with the invention. The sphere was fabricated from stainless steel and had an outer diameter of 9.5 inches and an inner diameter of 8 inches. Six acoustic drivers (i.e., transducers) were mounted as illustrated in FIG. 1. For the data shown in FIG. 19, the liquid within the chamber was acetone. During operation, the temperature of the acetone was −27.5° C. The driving frequency was 23.52 kHz, the driving amplitude was 59 V RMS, and the driving power was 8.8 watts. Two acoustic cycles are shown in FIG. 19. It will be appreciated that the data shown in FIG. 19 is only provided for illustration, and that the invention is not limited to this specific configuration.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. A method of assembling at least two port assemblies in a cavitation chamber, the method comprising the steps of:

boring a first cone-shaped port in a cavitation chamber wall of the cavitation chamber, wherein an external port diameter of said first port and associated with a cavitation chamber external surface is smaller than an internal port diameter of said first port and associated with a cavitation chamber internal surface;

boring a second cone-shaped port in said cavitation chamber wall of the cavitation chamber, wherein an external port diameter of said second port and associated with said cavitation chamber external surface is larger than an internal port diameter of said second port and associated with said cavitation chamber internal surface;

inserting a first member with a cone-shaped external surface corresponding to said first cone-shaped port through said second cone-shaped port into said cavitation chamber, wherein said first member is defined by a first diameter associated with said cavitation chamber internal surface and a second diameter associated with said cavitation chamber external surface, wherein said second diameter is smaller than said first diameter, and wherein said first diameter is smaller than said internal port diameter of said second port and larger than said external port diameter of said first port;

positioning said first member in said first cone-shaped port;

positioning a second member with a cone-shaped external surface within a corresponding cone-shaped internal surface of a mounting ring, said cone-shaped external surface of said second member defined by a third diameter associated with said cavitation chamber internal surface and a fourth diameter associated with said cavitation chamber external surface, wherein said third diameter is larger than said fourth diameter, and wherein said mounting ring has a cone-shaped external surface corresponding to said second cone-shaped port;

positioning said mounting ring within said second cone-shaped port; and locking said mounting ring in place within said second cone-shaped port with a retaining ring.

2. The method of claim 1, further comprising the step of securing said first member within said first cone-shaped port with an adhesive, wherein said first member securing step is performed prior to said second member positioning step.

3. The method of claim 1, further comprising the step of securing said second member within said mounting ring with an adhesive, wherein said second member securing step is performed prior to said mounting ring positioning step.

4. The method of claim 1, further comprising the step of coupling said retaining ring to said cavitation chamber external surface with a plurality of bolts.

5. The method of claim 1, further comprising the step of attaching a removable tool to an external chamber surface of said first member prior to said step of inserting said first member through said second cone-shaped port.

6. The method of claim 1, further comprising the steps of bonding a first tool to an external chamber surface of said first member and temporarily attaching a second tool to said first tool for use in said first member inserting step, wherein said bonding and attaching steps are performed prior to said step of inserting said first member through said second cone-shaped port.

7. The method of claim 6, wherein said bonding step is performed with a removable adhesive.

8. The method of claim 1, further comprising the steps of:

bonding a first tool to an external chamber surface of said first member;

temporarily attaching a second tool to said first tool for use in said first member inserting step;

temporarily attaching a third tool to said first tool for use in said first member positioning step; and detaching said second tool from said first tool prior to performing said first member positioning step.

9. The method of claim 8, wherein said bonding step is performed with a removable adhesive.

10. The method of claim 8, further comprising the steps of:

detaching said third tool from said first tool; and detaching said first tool from said external chamber surface of said first member after completion of said first member positioning step.

11. The method of claim 8, further comprising the step of applying an adhesive to at least a portion of said cone-shaped external surface of said first member, said applying step performed prior to said first member inserting step.

12. The method of claim 1, further comprising the step of selecting said first member from the group consisting of a window, a gas feed-thru, a liquid feed-thru, a mechanical feed-thru, a sensor, a sensor coupler, a transducer coupler, or a plug.

13. The method of claim 1, further comprising the step of selecting said second member from the group consisting of a window, a gas feed-thru, a liquid feed-thru, a mechanical feed-thru, a sensor, a sensor coupler, a transducer coupler, or a plug.

14. The method of claim 1, wherein said retaining ring is a retaining plate.

15. A method of assembling at least two port assemblies in a cavitation chamber, the method comprising the steps of:

boring a first cone-shaped port in a cavitation chamber wall of the cavitation chamber, wherein an external port diameter of said first port and associated with a cavitation chamber external surface is smaller than an internal port diameter of said first port and associated with a cavitation chamber internal surface;

boring a second port in said cavitation chamber wall of the cavitation chamber;

inserting a first member with a cone-shaped external surface corresponding to said first cone-shaped port through said second port into said cavitation chamber;

positioning said first member in said first cone-shaped port;

positioning a second member with a cone-shaped external surface within a corresponding cone-shaped internal surface of a retaining coupler, said cone-shaped external surface of said second member defined by a first diameter associated with said cavitation chamber internal surface and a second diameter associated with said cavitation chamber external surface, wherein said first diameter is larger than said second diameter, and wherein said retaining coupler has an external surface corresponding to said second port; positioning said retaining coupler within said second port; and locking said retaining coupler in place.

16. The method of claim 15, wherein said second port is cone-shaped, said cone-shaped second port defined by a third diameter associated with said cavitation chamber internal surface and a fourth diameter associated with said cavitation chamber external surface, wherein said third diameter is smaller than said fourth diameter, and wherein said retaining coupler has a cone-shaped external surface corresponding to said cone-shaped second port.

17. The method of claim 15, wherein said second port is cylindrically-shaped, and wherein said retaining coupler has a cylindrically-shaped external surface corresponding to said cylindrically-shaped second port.

18. The method of claim 15, further comprising the step of securing said first member within said first cone-shaped port with an adhesive, wherein said first member securing step is performed prior to said second member positioning step.

19. The method of claim 15, further comprising the step of securing said second member within said retaining coupler with an adhesive, wherein said second member securing step is performed prior to said retaining coupler positioning step.

20. The method of claim 15, further comprising the step of coupling said retaining coupler to said cavitation chamber external surface with a plurality of bolts.

21. The method of claim 15, further comprising the step of attaching a removable tool to an external chamber surface of said first member prior to said step of inserting said first member through said second port.

22. The method of claim 15, further comprising the steps of bonding a first tool to a external chamber surface of said first member ad temporarily attaching a second tool to said first tool for use in said first member inserting step, wherein said bonding ad attaching steps are performed prior to said step of inserting said first member through said second port.

23. The method of claim 22, wherein said bonding step is performed with a removable adhesive.

24. The method of claim 15, further comprising the steps of:

bonding a first tool to a external chamber surface of said first member;

temporarily attaching a second tool to said first tool for use in said first member inserting step;

temporarily attaching a third tool to said first tool for use in said first member positioning step; and detaching said second tool from said first tool prior to performing said first member positioning step.

25. The method of claim 24, wherein said bonding step is performed with a removable adhesive.

26. The method of claim 24, further comprising the steps of:

detaching said third tool from said first tool; and detaching said first tool from said external chamber surface of said first member after completion of said first member positioning step.

27. The method of claim 24, further comprising the step of applying an adhesive to at least a portion of said cone-shaped external surface of said first member, said applying step performed prior to said first member inserting step.

28. The method of claim 15, further comprising the step of selecting said first member from the group consisting of a window, a gas feed-thru, a liquid feed-thru, a mechanical feed-thru, a sensor, a sensor coupler, a transducer coupler, or a plug.

29. The method of claim 15, further comprising the step of selecting said second member from the group consisting of a window, a gas feed-thru, a liquid feed-thru, a mechanical feed-thru, a sensor, a sensor coupler, a transducer coupler, or a plug.

30. A method of assembling at least two port assemblies in a cavitation chamber, the method comprising the steps of:

boring a first cone-shaped port in a cavitation chamber wall of the cavitation chamber, wherein an external port diameter of said first port and associated with a cavitation chamber external surface is smaller than an internal port diameter of said first port and associated with a cavitation chamber internal surface;

boring a second port in said cavitation chamber wall of the cavitation chamber;

inserting a member with a cone-shaped external surface corresponding to said first cone-shaped port through said second port into said cavitation chamber;

positioning said member in said first cone-shaped port;

positioning a port cover within said second port; and locking said port cover in place.

31. The method of claim 30, wherein said second port is cone-shaped, said cone-shaped second port defined by a first diameter associated with said cavitation chamber internal surface and a second diameter associated with said cavitation chamber external surface, wherein said first diameter is smaller than said second diameter, and wherein said port cover has a cone-shaped external surface corresponding to said cone-shaped second port.

32. The method of claim 30, wherein said second port is cylindrically-shaped, and wherein said port cover has a cylindrically-shaped external surface corresponding to said cylindrically-shaped second port.

33. The method of claim 30, further comprising the step of securing said member within said first cone-shaped port with an adhesive, wherein said member securing step is performed prior to said port cover positioning step.

34. The method of claim 30, said locking step further comprising the step of bonding said port cover within said second port with an adhesive.

35. The method of claim 30, said locking step further comprising the step of coupling said port cover to said cavitation chamber external surface with a plurality of bolts.

36. The method of claim 30, further comprising the step of attaching a removable tool to an external chamber surface of said member prior to said step of inserting said member through said second port.

37. The method of claim 30, further comprising the steps of bonding a first tool to an external chamber surface of said member and temporarily attaching a second tool to said first tool for use in said member inserting step, wherein said bonding and attaching steps are performed prior to said step of inserting said member through said second port.

38. The method of claim 37, wherein said bonding step is performed with a removable adhesive.

39. The method of claim 30, further comprising the steps of:

bonding a first tool to an external chamber surface of said member;

temporarily attaching a second tool to said first tool for use in said member inserting step;

temporarily attaching a third tool to said first tool for use in said member positioning step; and detaching said second tool from said first tool prior to performing said member positioning step.

40. The method of claim 39, wherein said bonding step is performed with a removable adhesive.

41. The method of claim 39, further comprising the steps of:

detaching said third tool from said first tool; and detaching said first tool from said external chamber surface of said member after completion of said member positioning step.

42. The method of claim 39, further comprising the step of applying an adhesive to at least a portion of said cone-shaped external surface of said member, said applying step performed prior to said member inserting step.

43. The method of claim 30, further comprising the step of selecting said member from the group consisting of a window, a gas feed-thru, a liquid feed-thru, a mechanical feed-thru, a sensor, a sensor coupler, a transducer coupler, or a plug.

44. The method of claim 30, further comprising the step of integrating a feed-thru into said port cover.

45. The method of claim 30, further comprising the step of integrating a sensor into said port cover.

46. The method of claim 30, further comprising the step of integrating a transducer into said port cover.

* * * * *